US006582158B1

(12) United States Patent
Van Stein

(10) Patent No.: US 6,582,158 B1
(45) Date of Patent: Jun. 24, 2003

(54) DEVICE AND METHOD FOR TRANSFERRING VIBRATING MOVEMENT TO RIGID PIPE WITH PIPE CLAMP FOR VIBRATOR RAMMER BLOCK

(75) Inventor: Theodorus Gerhardus Wilhemus Van Stein, Linschoten (NL)

(73) Assignee: IHC Handling Systems, NLX ( * ) Notice: Subject to any disclaimer, the term of this patent is extended or adjusted under 35 U.S.C. 154(b) by 103 days.

(21) Appl. No.: 09/260,353

(22) Filed: Mar. 2, 1999

(30) Foreign Application Priority Data

Mar. 4, 1998 (NL) ..... 1008473

(51) Int. Cl.[7] ..... E02D 7/30; E02D 13/00

(52) U.S. Cl. ..... 405/228; 405/232; 405/246; 175/55

(58) Field of Search ..... 405/246, 247, 405/232, 228, 249; 175/55; 173/49

(56) References Cited

U.S. PATENT DOCUMENTS

| | | | | | |
|---|---|---|---|---|---|
| 2,847,830 | A | * | 8/1958 | Smith | 405/246 |
| 2,871,666 | A | * | 2/1959 | Pickman | 405/247 |
| 2,972,872 | A | * | 2/1961 | Kupka | 405/247 |
| 3,107,497 | A | * | 10/1963 | Hoppe | 405/246 |
| 3,145,541 | A | * | 8/1964 | Binnings | 405/246 |
| 3,214,918 | A | * | 11/1965 | Binnings | 405/246 |
| 3,232,061 | A | * | 2/1966 | Davis | 405/246 |
| 3,248,887 | A | * | 5/1966 | Templeton | 405/247 |
| 3,530,947 | A | * | 9/1970 | Gendron | 405/249 X |
| 3,624,760 | A | | 11/1971 | Bodine | 175/56 |
| 3,783,954 | A | * | 1/1974 | Bodine | 173/49 |
| 3,828,864 | A | * | 8/1974 | Haverkamp et al. | 405/232 X |
| 4,322,182 | A | * | 3/1982 | Ostgaard | 405/227 |
| 4,436,452 | A | * | 3/1984 | Bodine | 405/232 |
| 4,618,288 | A | * | 10/1986 | Daigle | 405/232 |
| 4,674,914 | A | * | 6/1987 | Wayman et al. | 405/154 |
| 5,355,964 | A | * | 10/1994 | White | 405/232 X |
| 5,544,979 | A | * | 8/1996 | White | 405/232 |
| 5,609,380 | A | * | 3/1997 | White | 405/232 X |
| 5,653,556 | A | * | 8/1997 | White | 405/249 |
| 5,802,888 | A | * | 9/1998 | Parsons | 70/16 |

FOREIGN PATENT DOCUMENTS

| | | | | |
|---|---|---|---|---|
| GB | 487057 | | 6/1938 | |
| GB | 2043755 | A * | 10/1980 | 405/232 |
| GB | 2099053 | A * | 12/1982 | 405/232 |

OTHER PUBLICATIONS

Japanese Abstract, Publication No. 08042273, Publication Date Feb. 13, 1996; Titled "Pile Driving Method Of Press–In Steel Pipe" By Kunismasu Susumu.

* cited by examiner

*Primary Examiner*—Heather Shackleford
*Assistant Examiner*—Jong-Suk Lee
(74) *Attorney, Agent, or Firm*—Williams, Morgan & Amerson

(57) ABSTRACT

A Device for transferring a vibrating movement to a rigid pipe for letting it penetrate into or removing it from a bed in upright or inclined position, comprises a clamping member for clampingly holding the upper end of the pipe for transfer of the vibrating movements thereto. The clamping members can be biased away from each other for clampingly engaging—exclusively—the inner surfaces of the pipe. The device further comprises a body to be attached to a vibrator block. The clamping members form a rigid unity with the body, considered in the axial direction of the pipe.

19 Claims, 3 Drawing Sheets

DEVICE AND METHOD FOR TRANSFERRING VIBRATING MOVEMENT TO RIGID PIPE WITH PIPE CLAMP FOR VIBRATOR RAMMER BLOCK

BACKGROUND OF THE INVENTION

1. Field of the Invention

The invention relates to a pipe clamp for either rams or blocks for removal, working with vibrations.

2. Description of the Related Art

It is known to ram or remove foundation pipes into or from a waterbed in a more or less straight up position by means of a vibrator block placed on the upper end of the pipe. Such pipes are used to secure a structure to the waterbed. To that end the structure, for instance a so-called "template", a "jacket" or a "frame" is provided at the corners with guide bushes for the foundation pipes which can be accommodated in there more or less fitting. With the help of a vibrator block each pipe is forced into the bed through the guide bush concerned and attached to the guide bush, with its upper end.

Known vibrator blocks are provided at their lower ends with at least two pairs of hydraulic operable clamping jaws which always clamp the upper end of the pipe wall between them at opposite locations. The clamping jaws engaging the outer side of the pipe result in a local enlargement of the diameter of the assembly pipe-clamp, as a result of which the pipe cannot entirely be lowered into the guide bush with its upper end.

However, it is often a requirement that the pipes have their upper ends flush with the upper edge of the guiding bushes concerned, so that the protruding upper portions of the pipes have to be cut off. For that purpose a special tool has to be lowered or divers have to be used, which entails high costs.

SUMMARY OF THE INVENTION

It is, an object of the invention to improve on this and to that end, from one aspect, provides a device for transferring a vibrating movement to a rigid pipe for letting it penetrate into or removing it from a bed in upright position, comprising clamping means for clampingly holding the upper end of the pipe for transfer of the vibrating movements thereto and biassing means for the clamping means, which clamping means comprise at least two clamping members that can be biassed away from each other by means of the biassing means, for clampingly engaging the -particularly opposite-inner surfaces of the pipe.

Because the pipe wall itself provides the counter clamping force and the pipe is exclusively engaged on—particularly opposite—inner surfaces, no clamping members that extend outside of the pipe wall are present. As a result the pipe can be rammed entirely into the guide bush, without the follow-up treatment of cutting off the upper end being necessary.

In a further development of the device according to the invention it comprises a body with means for attachment to a vibrator block, the clamping members forming a rigid unity with the body in pipe direction. The vibration forces (alternatingly upwards and downwards) are transferred here from the vibrator block, via the clamping members, to the pipe according to a direct force path.

Preferably the clamping means comprise one or more wedge members that can be moved in the direction of the pipe by the biassing means, which wedge members under tension press the clamping means radially outwards.

For reasons of constructive simplicity it is preferred if there is one central wedge member, which is active to several sides.

According to a further development the wedge members are provided with at least one wedge plane, of which the normal has a directional component in the direction towards the lower end of the pipe. Considered from another aspect the biassing means are active to move the wedge members in downward direction for biassing the clamping members. In this way the biassing means can be active from above and room is provided to the wedge members and the clamping members, so that they can be designed strong enough for nearly all purposes.

It is preferred here that the biassing means comprise a cylinder/piston assembly, the piston being situated above the clamping means, so that the space next to the clamping members is entirely available to the wedge members. If the device is further provided with a stop plate for the upper end of the pipe, it is preferred that the piston is situated above the stop plate. Furthermore also the cylinder of the cylinder/piston assembly is preferably situated entirely above the clamping means.

A further simplified construction and reliable working is realized when the piston rod of the cylinder/piston assembly is directly attached to the wedge members at the end which faces away from the piston.

The taking up of space in radial direction is kept small according to a further development of the device according to the invention when the wedge members are provided with a series of wedge planes which are arranged saw-toothed in the pipe direction. The taking up of space in radial direction here can even be independent from the engagement length of the clamping members in the pipe direction.

This saved space can for instance be used for making the clamping members two-pieced, the clamping members being assembled from an inner clamping part, which for wedge activity abuts the wedge member concerned, and an outer clamping part, which is detachably arranged on the inner clamping member. Thus the device can be used for various very different pipe diameters, by changing the outer clamping members.

According to a further development the wedge member and the clamping member are connected to each other by means of a pin/slit connection, the slit extending in pipe direction. In this way the wedge member can slide in pipe direction with respect to the clamping member.

It is noted that from CH-A-400.023 a device is known for transferring forces to a pipe for letting it penetrate in a bed or removing it from it. This device comprises clamping means with a wall with filling pieces extending over the pipe and a centrally situated wedge member and further wedge members intended to engage the inner surface of the pipe attached around it extending within the pipe. In use fluid under pressure is supplied in order to force a piston which is operatively connected to the central wedge member, upwards and therewith force the further wedge members against the inner surface of the pipe. The intention here is to deform the pipe outwardly at that location so that it will closely abut the wall and/or filling pieces extending over the pipe.

From a further aspect the invention relates to an assembly of a device according to the invention and a vibrating block.

From yet another aspect the invention provides a method for transferring a vibrating movement on a rigid pipe for letting it penetrate into or removing it from a bed in upright position, the clamping means of the assembly according to the invention being inserted in the upper end of the pipe, the biassing means being activated to let the clamping means clampingly engage the inner surfaces of the pipe and keeping them clamped, without noticeable deformation of the circumference of the pipe at that location, and subsequently activating the vibrator block.

Preferably exclusively those circumferential surfaces of the pipe are clampingly engaged, which are situated on the inside of the pipe.

BRIEF DESCRIPTION OF THE DRAWING

The invention will be elucidated on the basis of the exemplary embodiment shown in the attached drawings, in which.

DESCRIPTION OF THE PREFERRED EMBODIMENTS

Figure 1:
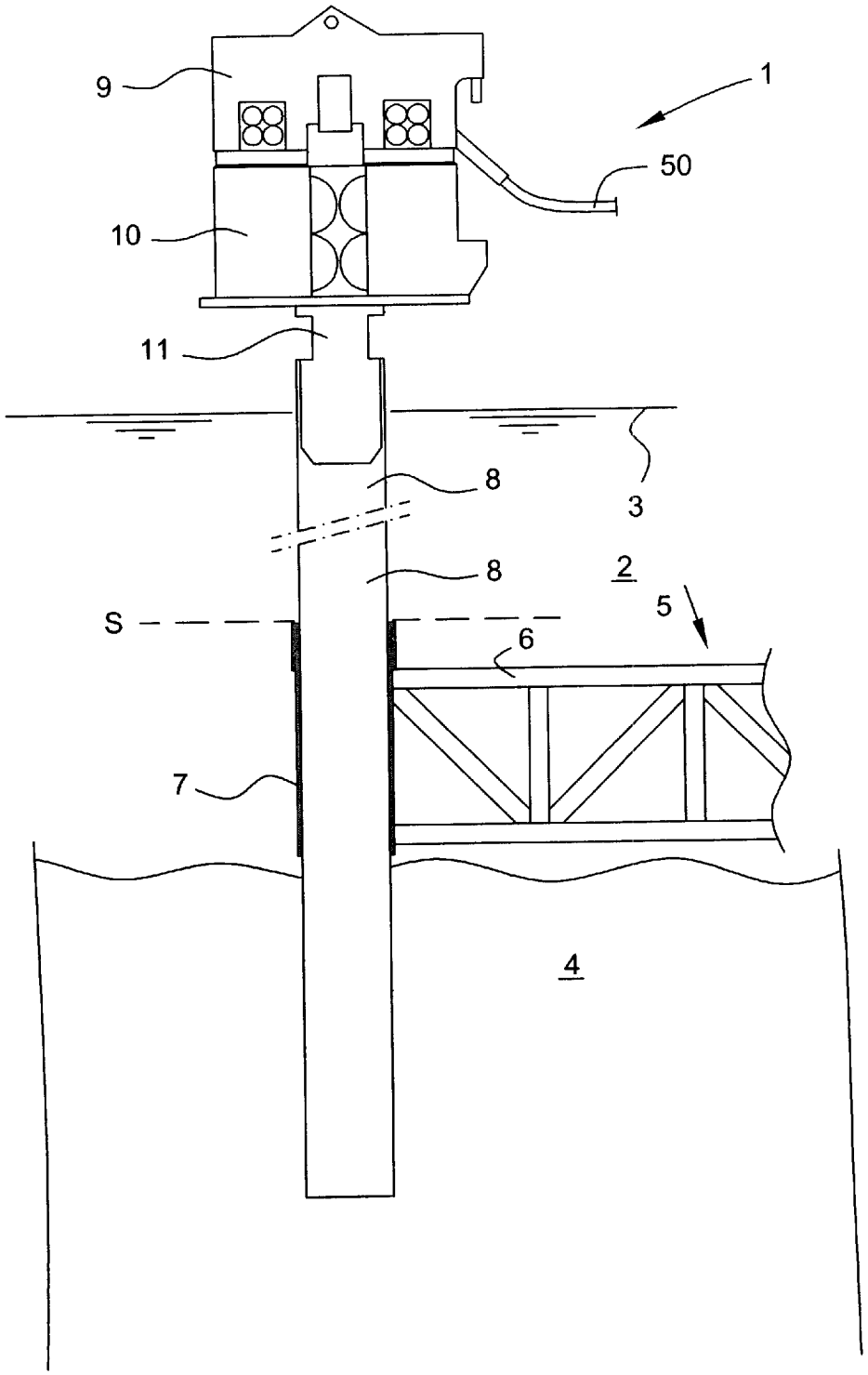
FIG. 1 shows a schematical view on an arrangement for driving a pipe into a seabed with the aid of an exemplary embodiment of the device according to the invention.

In FIG. 1 a vibrator block 1 is shown which is provided with a pulling head 9 and a vibrator member 10 with eccentric weights and hydro engine, the vibrator block 1 being connected to a hydraulic unit and operation means by means of a hydraulic lead 50 and at the bottom being provided with a clamping device 11 according to the invention. The clamping device 11 is inserted in the upper end of a pipe 8, which pipe 8 extends downwards until in the seabed 4 from the water surface 3 of an aqueous body 2. With the help of the pipe 8 a corner of a so-called template 5 comprising a frame 6 and on each corner a guide bush 7 is secured.

The clamping device 11 only extends into the upper end of the pipe 8 and not at its outer side. In this way with the help of the vibrator block 1 the upper end of the pipe 8 can actually be brought to the level S or below it, the upper edge of the pipe 8 being situated in one plane S with the upper edge of the guide bush 7, or below it. After that with the help of suitable hoisting elements the vibrator block 1 can simply be hoisted out of the pipe 8 after the clamping means of the clamping device 11 have been deactivated.

Figure 2:
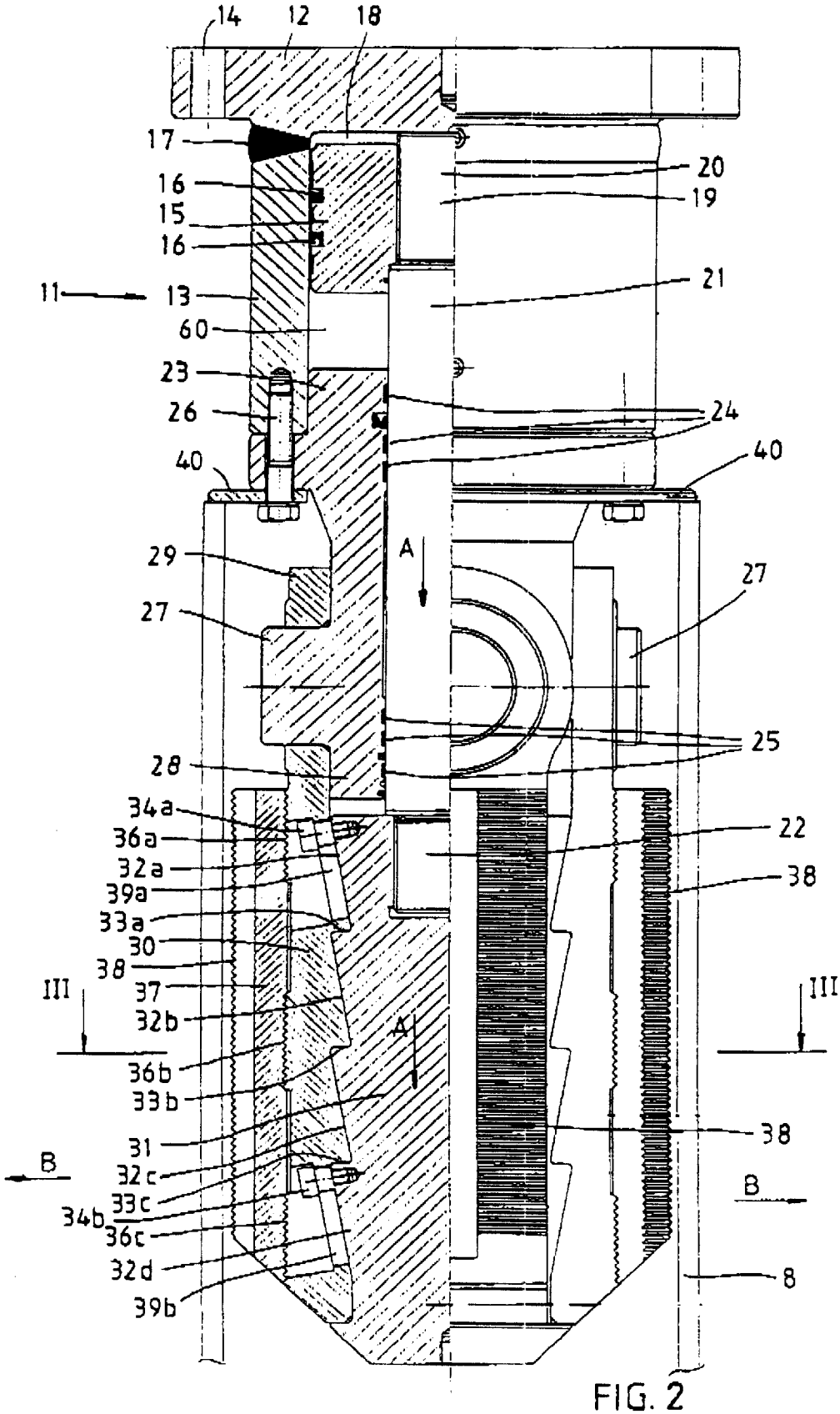
FIG. 2 shows a combined cross-section and side view of the exemplary embodiment of the device according to the invention.

In FIG. 2 on the left-hand side a vertical cross-section through the clamping device 11 is shown, and on the right-hand side a side view thereon.

The clamping device 11 comprises an upper plate 12, which is provided with a series of holes 14 with which the upper plate 12 and therewith the clamping device 11 can be attached to the vibrator block 10. A cylinder casing 13 defining a cylindrical space 60 is formed as a unity with the upper plate 12. In the cylindrical space 60 an annular piston 15 is accommodated, which by means of sealing rings 16 sealingly abuts the inner surface of the casing 13. Above the piston 15 a pressure chamber 18 is situated, which chamber by means of gate 17 communicates with a hydraulic pressure lead, not shown, to a hydraulic pressure source. The pressure in the lead is adjustable by means of means not further shown. The piston 1 5 is screwed to the upper end 20 of a piston rod 19, which further comprises an intermediate part 21 and a lower end 22. The piston rod 19, in particular its intermediate part 21, is sealingly and slidingly accommodated in block 23 with the help of sealing rings 24 and 25, the block being attached to the casing 13 by means of bolts 26 and provided with radially protruding attachment studs 27.

With the help of bolts 26 a stop plate 40 is also attached to the block 23 and thus to the casing 13, which stop plate 40 serves as positioning means for the clamping device 11 on the upper edge of the pipe 8.

The upper end 20 of the piston rod 19 extends upwards to beyond the piston 15, so that always some space remains left above the piston 15 and the hydraulic pressure means can easily get above the piston 15.

A central wedge member 31 is screwed on the lower end 22 of the piston rod 19 which wedge member 31 at the—in this example four—sides is provided with wedge surfaces 32*a–d* arranged saw-toothed, which are each oriented obliquely downwards and to the outside and to below and merge into each other by means of horizontal steps 33*a*–33*c*.

Inner clamping plates 30 are hung on the radial studs 27, here four in number, with the help of annular upper ends 29, which plates are kept in their places in axial direction of the pipe 8 with respect to block 23 by the studs 27. The radial inner surface of the inner clamping plates 30 is saw-toothed, in order to suit the saw-toothed surface of the central wedge member 31. At the upper side and the lower side each inner clamping plate 30 is provided with a vertical slit 39*a, b,* in which a pin 34*a, b* attached in the central wedge member 31 extends.

Figure 3:
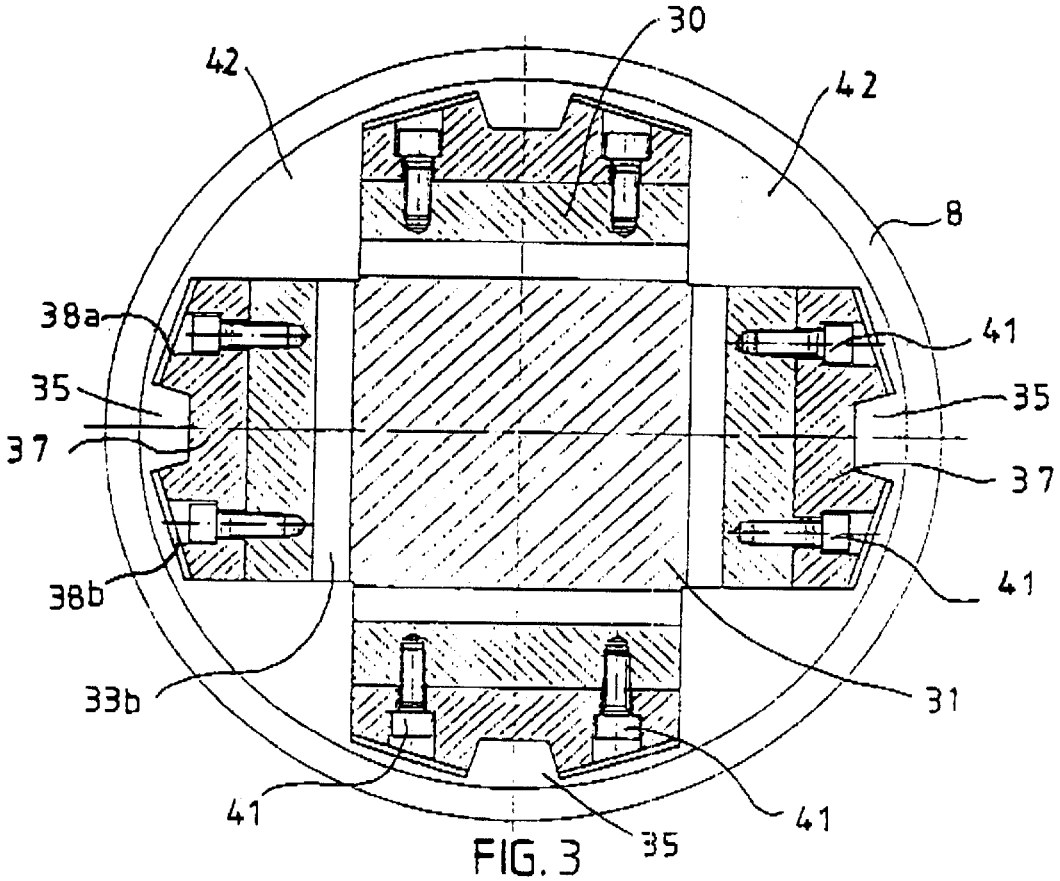
FIG. 3 shows a cross-section according to arrow III in FIG. 2.

The radial outer surface of the inner clamping plates 30 is provided with a number of vertical teeth 36*a,* 36*b* and 36*c,* with which the inner clamping plates 30 engage counter to axial sliding in corresponding teeth on outer clamping plates 37 placed against it. As can be seen in FIG. 3 the outer clamping plates 37 are tightened against the inner clamping plates 30 by means of a number of bolts 41. Furthermore it can be seen that the outer clamping plates 37 are provided with two series of teeth 38*a,* 38*b* that are inclined with respect to each other and separated from each other by a vertical slit 35. The teeth 38*a,* 38*b* can, as a result, be formed straight in horizontal direction and still be correctly oriented for an optimal engagement of the inner surface of the pipe 8.

When the pipe 8 has to be vibrated into the bed 4 (both offshore and onshore) the clamping device 11 is attached to the vibrator block 1, lowered in the upper end of the pipe 8, until the plate 40 rests on the upper edge of the pipe 8. Subsequently via gate 17 the space 18 is pressurized at a predetermined pressure, which is very high, for instance 320 bar,—adjusted to the radial outward pressure maximally to be taken by the tube, depending on the thickness of the wall and the kind of material—, as a result of which the piston 15 and thus the piston rod 21 is pushed downwards in the direction A with great force. In this way the central wedge member 31 will also be forced downwards in the direction A. The clamping plates 30 and 37, however, remain in their places in axial direction with respect to the block 23, by the engagement of the annular upper end 29 on the studs 27.

During the downward movement of the central wedge member 31 the pins 34*a,* 34*b* slide downwards within the slots 29*a,* 29*b*. As a result of the oblique orientation of the surfaces 32*a*–32*d* and the inner clamping plates 30 remaining axially in their places, the inner clamping plates 30 will be forced radially to the outside in the direction B. The annular upper ends 29 here radially slide to the outside over the studs 27, so that the clamping plates will not tilt. As a result of the connection between the inner clamping plates 30 and the outer clamping plates 37 the latter will also be forced to the outside in the direction B, and the teeth 38*a*, 38*b* will be forced in the inner surface of the pipe 8 with great force. The clamping forces that can be reached here are large enough the maintain the engagement between the clamping device 11 and the pipe 8 when vibrating the pipe 8 into the bed and low enough to prevent deformation of the circumference of the pipe at that location. By way of example there could be a vibration frequency of 23 Hertz with a double amplitude of 25 mm and a maximal downward force in the order of 250 tons and a maximal upward force of a similar order of magnitude, with maximal accelerations in the order of 25 G. The vibrating forces here are directly passed on from the vibrator block 10, via the upper plate 12, the casing 13, the block 23, the studs 27, the inner clamping plates 30 and the outer clamping plates 37 to the pipe wall.

As can be seen in FIG. 3 the clamping device 11 leaves a number of vertical passages 35 and 42 open, through which passages water can flow along the clamping device 11 in order to either enter the pipe 8 or to leave it. In this way an unwanted pressure build-up of the water in the pipe 8 during ramming is prevented.

The clamping device 11 is also suitable to be used in a similar manner during the removal of pipes from the bed. The possibly present guide bush does not impede the placing of the clamping device.

What is claimed is:

1. A device for transferring a vibrating movement to a rigid pipe for letting it penetrate into or removing it from a bed in upright position, comprising clamping means for clampingly holding the upper end of the pipe for transfer of the vibrating movements thereto and biasing means for the clamping means, the biasing means comprises a cylinder/piston assembly arranged to extend in an axial direction of the pipe, wherein the clamping means comprises at least two clamping members and one or more wedge members which are positioned for wedging interaction with the clamping members upon activation of the cylinder/piston assembly to bias the clamping members radially outwardly away from each other for clampingly engaging the inner surfaces of the pipe, the device further comprising a body with means for attachment to a vibrator block, the clamping members forming a rigid unity with the body, considered in the axial direction of the pipe.

2. The device according to claim 1, provided with clamping members engaging the circumferential surfaces of pipe, said clamping members being placed to exclusively engage the circumferential inner surfaces of the pipe.

3. The device according to claim 1, only one central wedge member being present, which is active to several sides in radially outward direction.

4. The device according to claim 3, the clamping members being assembled from an inner clamping part, which for the wedge activity abuts the wedge member concerned, and an outer clamping part, which is detachably arranged on the inner clamping member.

5. The device according to claim 3, the wedge member and the clamping member being connected to each other by means of a pin/slit connection, the slit extending in the axial direction of the pipe.

6. The device according to claim 1 the wedge members being provided with at least one wedge plane arranged inclined with respect to the pipe axis, said wedge plane having a normal line which has a directional component in the direction towards the lower end of the pipe.

7. The device according to claim 6, the wedge members having a wedge surface comprising a series of parallel wedge planes which are arranged in a saw-toothed manner in the axial direction of the pipe.

8. The device according to claim 1, said cylinder/piston assembly having a piston, said piston being situated above the clamping means.

9. The device according to claim 8, furthermore provided with adjustable means for limiting the fluid pressure in the cylinder/piston assembly and thereby the generated clamping forces by the clamping members.

10. The device according to claim 8, furthermore provided with a stop plate for the upper end of the pipe, the piston being situated above the stop plate.

11. The device according to claim 8, the cylinder of the cylinder/piston assembly being situated entirely above the clamping means.

12. The device according to claim 8, said cylinder/piston assembly having a piston rod, said piston rod being directly attached to the wedge members at the end which faces away from the piston.

13. An assembly of a device according to claim 1, further comprising a vibrator block.

14. A method for transferring a vibrating movement on a rigid pipe for letting it penetrate into or removing it from a bed, the method comprising the steps of positioning the rigid pipe in an upright position, inserting the clamping means of the assembly of claim 13 in the upper end of the pipe, activating the biasing means to let the clamping means clampingly engage the inner surfaces of the pipe and keeping them clamped, without noticeable deformation of the circumference of the pipe at that location, and subsequently activating the vibrator block.

15. The method according to claim 14, exclusively those circumferential surfaces of the pipe being clampingly engaged, which are situated on the inside of the pipe.

16. A method for transferring a vibrating movement on a rigid pipe for letting the pipe penetrate into or be removed from a bed, the method comprising:

inserting the clamping means of the assembly of claim 13, in the upper end of the pipe, where the pipe is oriented with its longitudinal axis in a generally upright position;

activating the biasing means to let the clamping means engage the inner surfaces of the pipe at a first location without significantly deforming the circumference of the pipe at the first location;

activating the vibrator block; and urging the pipe to move within the bed in a direction generally aligned with the longitudinal axis.

17. The method of claim 16, wherein urging the pipe to move within the bed in a direction generally aligned with the longitudinal axis further comprises urging the pipe to move into the bed.

18. The method of claim 16, wherein urging the pipe to move within the bed in a direction generally aligned with the longitudinal axis further comprises urging the pipe to move out of the bed.

19. The device according to claim 1, wherein the one or more wedge members are arranged for movement in the axial direction of the pipe by the cylinder/piston assembly.

* * * * *